US005255800A

United States Patent [19]

Kelly

[11] Patent Number: 5,255,800

[45] Date of Patent: Oct. 26, 1993

[54] SPARE TISSUE HOLDER ASSEMBLY

[76] Inventor: Keith N. Kelly, 2931 Wildflower Trail, Dublin, Ohio 43017

[21] Appl. No.: 921,626

[22] Filed: Jul. 30, 1992

[51] Int. Cl.[5] ..... A47F 5/08

[52] U.S. Cl. ..... 211/89; 242/55.3; 403/268; 248/205.3; 248/206.5

[58] Field of Search ..... 211/87, 89; 242/55.2, 242/55.3, 55.53; 312/34.22, 34.24; 403/265, 266, 267, 268; 248/205.3, 224.3, 229, 313, 206.5

[56] References Cited

U.S. PATENT DOCUMENTS

| | | | |
|---|---|---|---|
| D. 187,853 | 5/1960 | Smith | 242/55.2 |
| 892,214 | 6/1908 | Bennet | 242/55.3 |
| 1,436,990 | 11/1922 | Lillibridge | 312/34.24 |
| 1,876,828 | 9/1932 | Ashfield | 211/87 X |
| 2,834,566 | 5/1958 | Bower | 224/42.45 R |
| 3,168,275 | 2/1965 | Grondin | 248/311.2 X |
| 3,738,721 | 6/1973 | Maschek et al. | 242/55.3 |
| 4,205,802 | 6/1980 | Economakis | 242/55.3 |
| 4,593,878 | 6/1986 | Stewart | 248/205.3 X |
| 4,605,292 | 8/1986 | McIntosh | 248/206.5 X |
| 4,616,755 | 10/1986 | Adolfsson | 211/50 X |
| 4,678,150 | 7/1987 | Newman et al. | 403/268 X |
| 4,681,477 | 7/1987 | Fischer | 403/268 X |
| 4,775,109 | 10/1988 | Tegg | 242/55.3 |
| 4,850,502 | 7/1989 | Davis | 224/901 X |

FOREIGN PATENT DOCUMENTS

| | | | |
|---|---|---|---|
| 428715 | 5/1935 | United Kingdom | 242/55.3 |

*Primary Examiner*—David A. Scherbel
*Assistant Examiner*—Korie H. Chan
*Attorney, Agent, or Firm*—Leon Gilden

[57] ABSTRACT

A tissue holder arranged to secure a roll of tissue in a stored configuration in adjacency relative to a conventional tissue roll dispenser is provided, with the spare tissue holder having a base and a plurality of arcuate finger members mounted to the base to secure a tissue roll therebetween.

1 Claim, 4 Drawing Sheets

SPARE TISSUE HOLDER ASSEMBLY

BACKGROUND OF THE INVENTION

1. Field of the Invention

The field of invention relates to tissue holder structure, and more particularly pertains to a new and improved spare tissue holder assembly wherein the same is arranged for accommodating a tissue roll in adjacency to a tissue roll dispenser.

2. Description of the Prior Art

The use of tissue roll dispensers of various types is utilized throughout the prior art and exemplified in the U.S. Pat. Nos. 4,826,063; 4,373,682; and 4,634,067. Accommodating various storage of tissue rolls is exemplified in the U.S. Pat. No. 4,098,469.

The instant invention attempts to overcome deficiencies of the prior art by providing for a spare tissue holder assembly arranged for use in conjunction with a conventional roll dispenser and in combination thereto to provide for ease of storage and retrofit of the spare tissue holder assembly relative to an associated tissue roll dispenser and in this respect, the present invention substantially fulfills this need.

SUMMARY OF THE INVENTION

In view of the foregoing disadvantages inherent in the known types of tissue holder structure now present in the prior art, the present invention provides a spare tissue holder assembly wherein the same utilizes a spring-biased clamp structure to secure a tissue roll therebetween for storage thereof. As such, the general purpose of the present invention, which will be described subsequently in greater detail, is to provide a new and improved spare tissue holder assembly which has all the advantages of the prior art tissue holder structure and none of the disadvantages.

To attain this, the present invention provides a tissue holder arranged to secure a roll of tissue in a stored configuration in adjacency relative to a conventional tissue roll dispenser, with the spare tissue holder having a base and a plurality of arcuate finger members mounted to the base to secure a tissue roll therebetween.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spare tissue holder assembly which has all the advantages of the prior art tissue holder structure and none of the disadvantages.

It is another object of the present invention to provide a new and improved spare tissue holder assembly which may be easily and efficiently manufactured and marketed.

It is a further object of the present invention to provide a new and improved spare tissue holder assembly which is of a durable and reliable construction.

An even further object of the present invention is to provide a new and improved spare tissue holder assembly which is susceptible of a low cost of manufacture with regard to both materials and labor, and which accordingly is then susceptible of low prices of sale to the consuming public, thereby making such spare tissue holder assemblies economically available to the buying public.

Still yet another object of the present invention is to provide a new and improved spare tissue holder assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
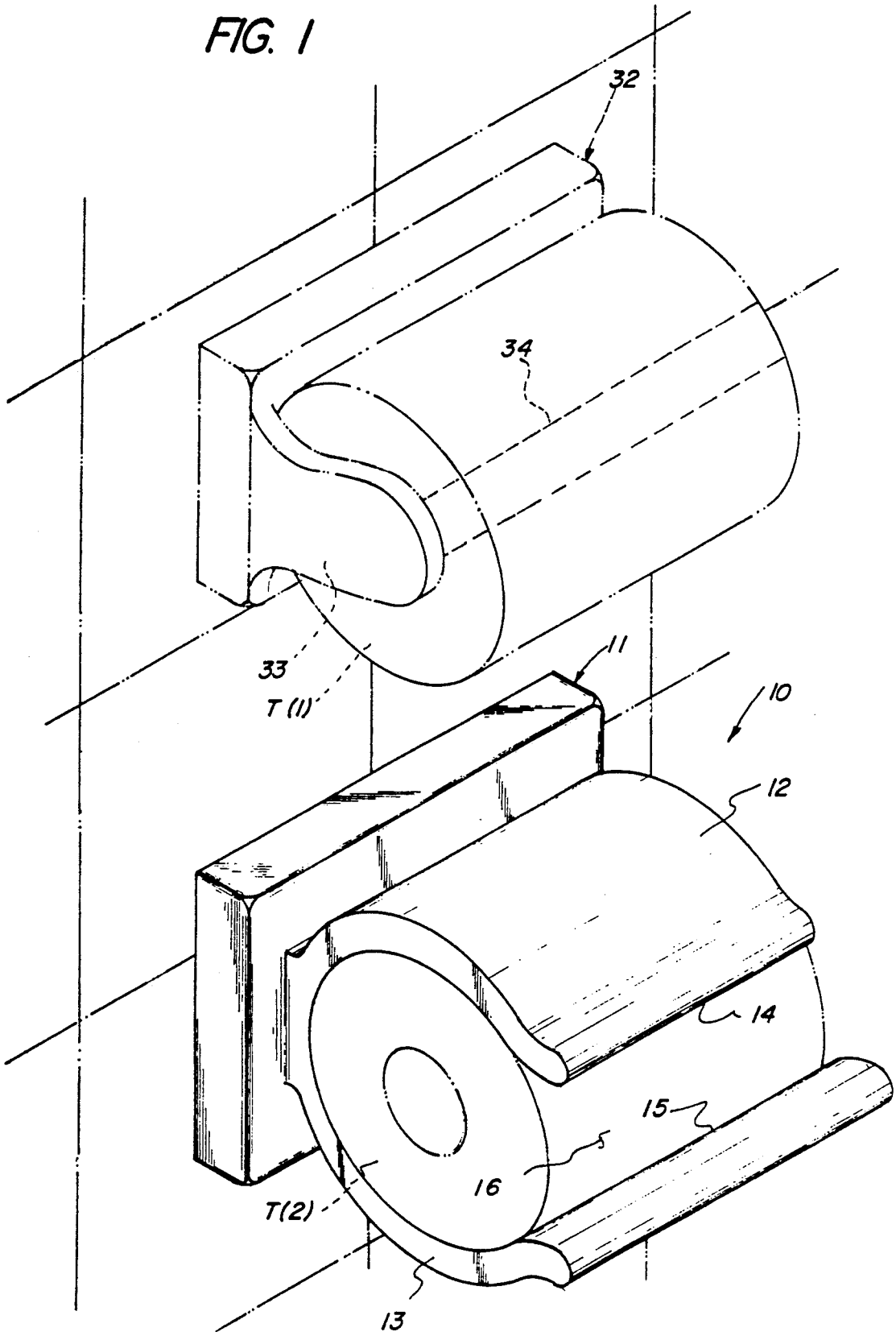
FIG. 1 is an isometric illustration of the instant invention.

With reference now to the drawings, and in particular to FIGS. 1 to 7 thereof, a new and improved spare tissue holder assembly embodying the principles and concepts of the present invention and generally designated by the reference numerals 10 and 10*a* will be described.

More specifically, the spare tissue holder assembly 10 of the instant invention essentially comprises operative association with a tissue roll dispenser 32 having support arms 33 mounting a roll axle 34 to secure a first tissue roll T(1) for selective dispensing of the tissue roll T(1).

Figure 2:
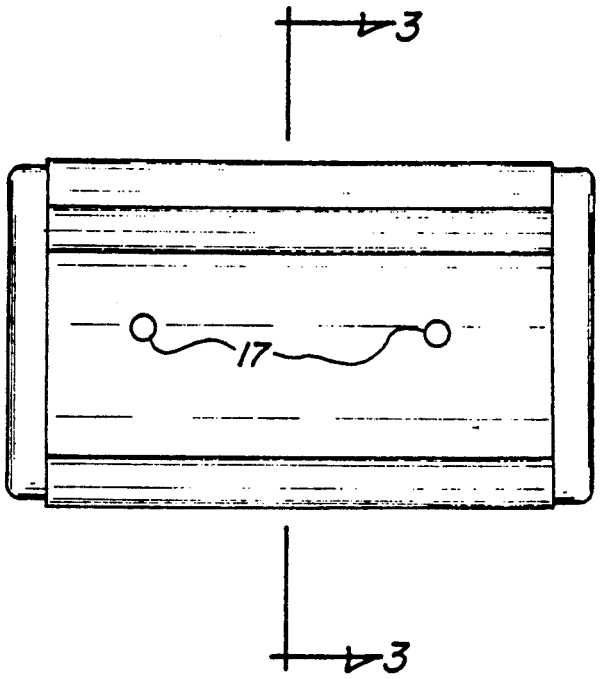
FIG. 2 is an orthographic rear view of the spare tissue holder assembly of the invention.
Figure 3:
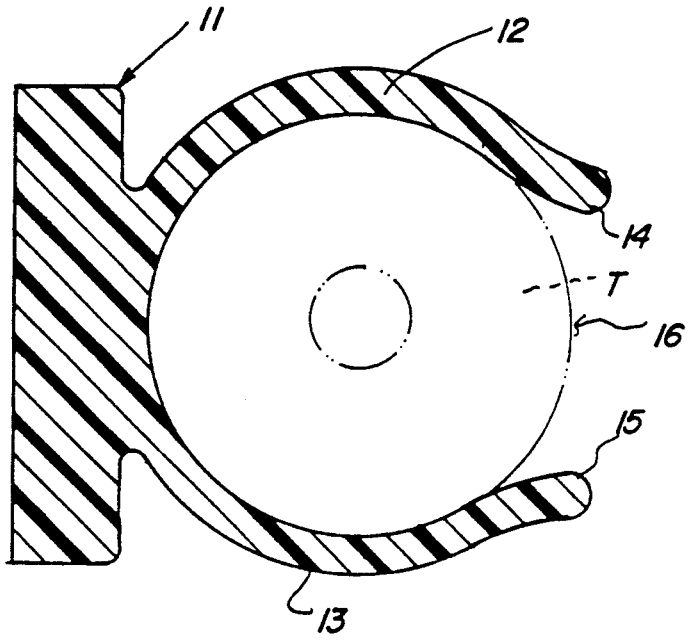
FIG. 3 is an orthographic side view, taken along the lines 3—3 of FIG. 2 in the direction indicated by the arrows.

To provide for ease of access to and the presentation of a spare tissue roll T(2), a base plate 11 includes respective first and second arcuate fingers 12 and 13 fixedly mounted to the base plate, with the arcuate fingers 12 and 13 defining a cylindrical cavity therebetween having an access gap 16 directed between the first and second arcuate fingers 12 and 13 defined between respective first and second frontal linear edges 14 and 15 respectively of the first and second arcuate fingers 12 and 13. Base plate fastener openings 17 may be provided, as illustrated in FIG. 2, to utilize conventional fasteners to secure the holder assembly 10 to the vertical wall surface in adjacency to the tissue roll dispenser 32.

Figure 4:
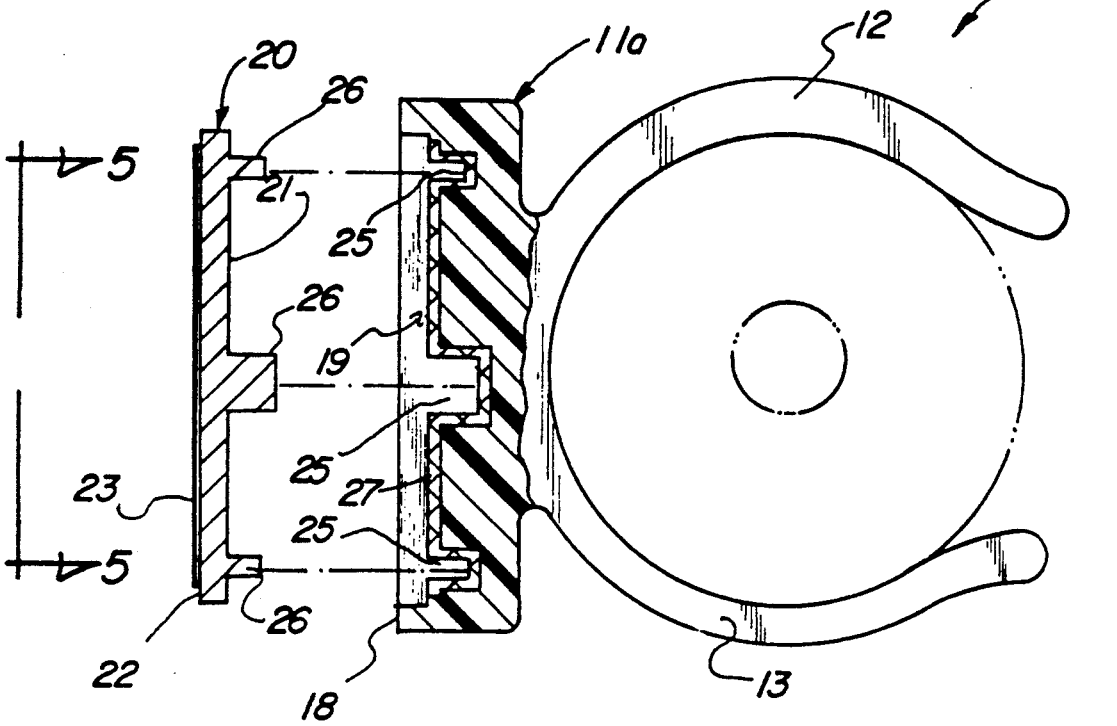
FIG. 4 is an orthographic side view, partially in section, of a modified tissue holder assembly of the invention.
Figure 5:
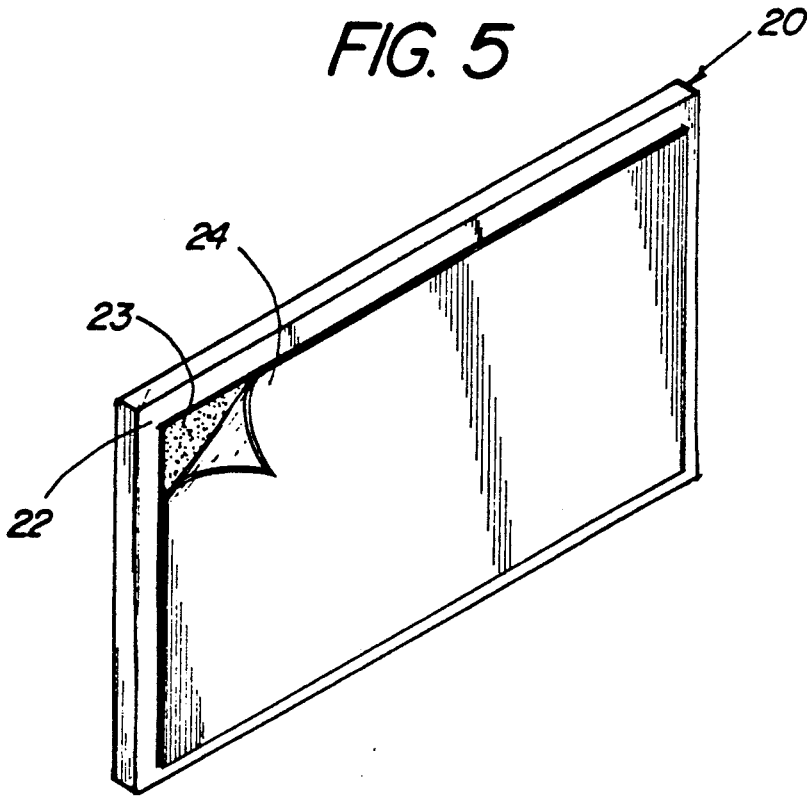
FIG. 5 is an orthographic view, taken along the lines 5—5 of FIG. 4 in the direction indicated by the arrows.

The invention as indicated in the FIG. 4 by the numeral 10*a* includes a modified base plate 11*a* having a base plate rear wall 18, including a base plate cavity 19 directed into the base plate extending from the rear wall. A mounting plate 20 is provided for assemblage to the base plate, with the mounting plate 20 including a mounting plate front wall having a plurality of mounting plate front wall projections 26 received within base plate cavity bores 25 intersecting the base plate cavity 19. The bores 25 are spaced apart a predetermined spacing substantially equal to a predetermined spacing of the projections 26. An adhesive layer 23 is mounted to the mounting plate rear wall 22 accessed by a peel-away flexible web 24, whereupon removal of the web permits selective positioning of the mounting plate 20 onto the vertical wall surface in adjacency relative to the tissue roll dispenser 32. A ferromagnetic liner 27 is mounted coextensively along a floor of the base plate cavity 19 and directed into the bores 25 cooperative with the ferrous metallic mounting plate 20 and the projections 26.

Figure 6:
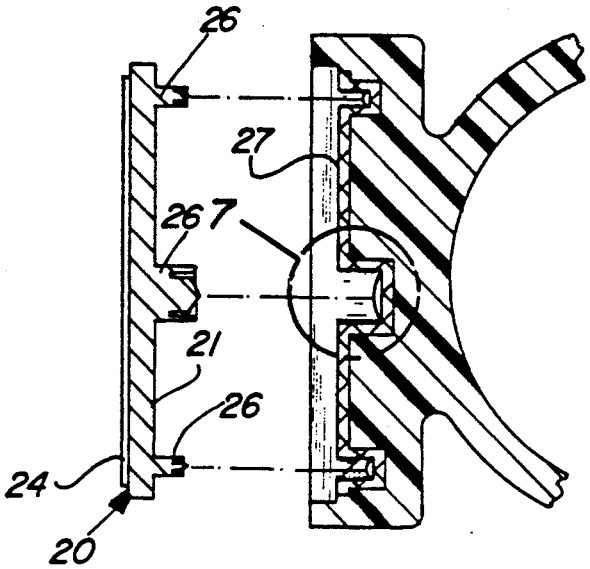
FIG. 6 is an orthographic side view of a further modified aspect of the invention.
Figure 7:
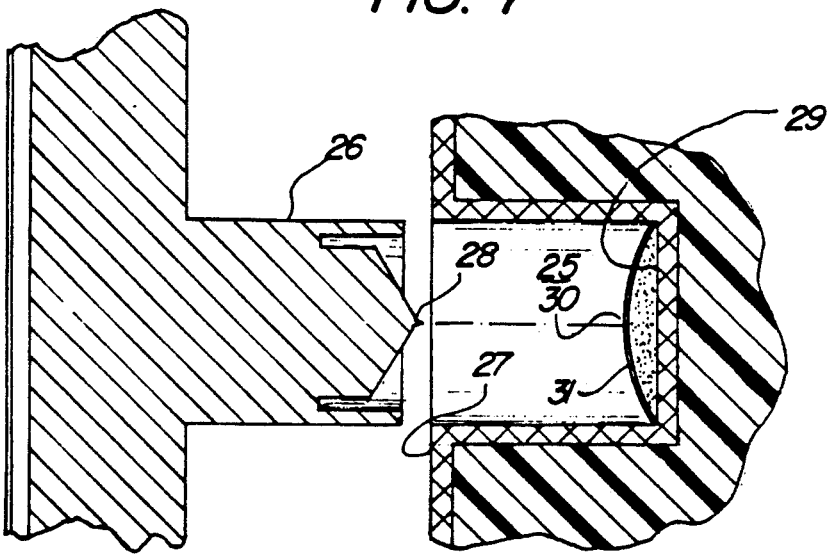
FIG. 7 is an orthographic view of section 7 as set forth in FIG. 6.
Figure 8:
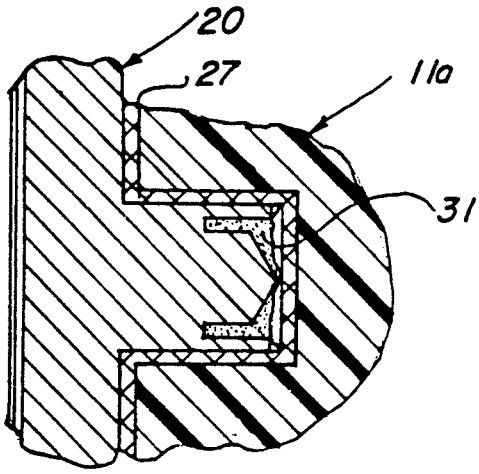
FIG. 8 is an orthographic view of the invention in an assembled configuration, as set forth in FIG. 7.

The invention as indicated in the FIGS. 6–8 includes a bore floor 29 of each bore 25 having a membrane film 30 overlying an adhesive fluid 31. Each of the projections 26 includes a pointed forward end 28, whereupon manual projection of the base plate 18 effects projection of each pointed forward end 28 to rupture each associated membrane film 30 to direct the adhesive fluid 31 to permanently secure the mounting plate to the base plate 11*a* for permanent assemblage. Otherwise, individuals may selectively remove the assembly 10*a* for storage until use for quests and the like that have access as required to the second tissue roll T(2).

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A spare tissue holder assembly in combination with a tissue roll dispenser, with the tissue roll dispenser having an axle, the axle arranged for rotatably mounting a first tissue roll thereon, and the spare tissue holder assembly including a base plate, the base plate including a base plate front wall, the base plate front wall having a first arcuate finger and a second arcuate finger vertically spaced on said base plate and arranged in confronting coextensive relationship relative to one another, with a cylindrical cavity oriented between the first arcuate finger and the second arcuate finger, and the first arcuate finger including a first linear edge, the second arcuate finger including a second linear edge, wherein the first linear edge and the second linear edge are arranged in a parallel spaced relationship having an access gap therebetween for access to a second tissue roll positioned within the cavity, and the base plate includes a base plate rear wall, the base plate rear wall including a base plate cavity, the base plate cavity having a plurality of cavity bores orthogonally oriented relative to the base plate rear wall, and a mounting plate, the mounting plate having a mounting plate front wall, the mounting plate front wall having a plurality of mounting plate front wall projections, wherein the bores are spaced apart a predetermined spacing, and the projections are spaced apart said predetermined spacing, and each of said projections is arranged for reception within one of said bores, and the base plate cavity includes a base plate cavity floor, and the base plate cavity floor and the bores include a magnetic layer coextensive therewith, and the mounting plate and the mounting plate projections are formed of a ferrous metallic material, and each of the bores includes a bore floor, and each of the projections includes a projection forward pointed end, and each bore floor includes a membrane film, with an adhesive fluid contained between each membrane film and each bore floor, and each projection includes a pointed forward end for piercing the membrane film when each pointed forward end is directed into each membrane film.

* * * * *